US006857870B2

(12) United States Patent
Topp

(10) Patent No.: US 6,857,870 B2
(45) Date of Patent: Feb. 22, 2005

(54) COMBUSTION SYSTEM FOR A HEATER

(75) Inventor: Daniel P. Topp, West Chester, PA (US)

(73) Assignee: Topp Construction Services, Inc., Aston, PA (US)

( * ) Notice: Subject to any disclaimer, the term of this patent is extended or adjusted under 35 U.S.C. 154(b) by 123 days.

(21) Appl. No.: 09/852,445

(22) Filed: May 9, 2001

(65) Prior Publication Data

US 2002/0166553 A1 Nov. 14, 2002

(51) Int. Cl.[7] ..... F23D 1/00; F23D 14/46
(52) U.S. Cl. ..... 431/350; 431/174; 126/110 C
(58) Field of Search ..... 126/110 B, 110 C, 126/110 D; 432/222; 431/353, 354, 181, 185, 9, 10, 350–352, 363; 60/737, 738

(56) References Cited

U.S. PATENT DOCUMENTS

| | | | | | |
|---|---|---|---|---|---|
| 460,054 | A | * | 9/1891 | Rhind | 431/352 |
| RE25,626 | E | * | 7/1964 | Yeo et al. | 431/157 |
| 3,267,928 | A | * | 8/1966 | Spooner | 126/110 B |
| 3,405,921 | A | * | 10/1968 | Rohrs | 432/222 |
| 3,625,495 | A | * | 12/1971 | Harter et al. | 432/223 |
| 4,244,349 | A | * | 1/1981 | Velie et al. | 126/110 C |
| 4,443,187 | A | * | 4/1984 | Shaftner et al. | 126/110 B |
| 4,444,724 | A | * | 4/1984 | Goetschius | 422/173 |
| 4,458,663 | A | * | 7/1984 | Kanesaka | 126/116 A |
| 4,848,313 | A | * | 7/1989 | Velie | 126/110 B |
| 5,017,129 | A | | 5/1991 | Velie et al. | 431/326 |
| 5,052,367 | A | * | 10/1991 | Beavers et al. | 126/110 B |
| 5,540,213 | A | * | 7/1996 | Shell et al. | 126/109 |
| 5,848,585 | A | | 12/1998 | Long et al. | 126/110 B |
| RE36,373 | E | * | 11/1999 | Benz et al. | 431/115 |
| 6,065,468 | A | | 5/2000 | Willey et al. | 126/110 B |
| 6,138,666 | A | | 10/2000 | Hubbard | 126/307 R |
| 6,152,128 | A | | 11/2000 | Willey et al. | 126/110 B |

FOREIGN PATENT DOCUMENTS

| | | | | |
|---|---|---|---|---|
| JP | 58179718 | A | * 10/1983 | F23D/15/00 |

* cited by examiner

*Primary Examiner*—Henry Bennett
*Assistant Examiner*—Kathryn Odland
(74) *Attorney, Agent, or Firm*—Mark A. Garzia, P.C.

(57) ABSTRACT

A combustion system for a portable forced air heater having two frusta-conical sections attached to a circular burner tube, wherein each frusta-conical section has pre-determined vent hole patterns that allow the gas heater to have a variable burn rate.

21 Claims, 6 Drawing Sheets

FIG. 3
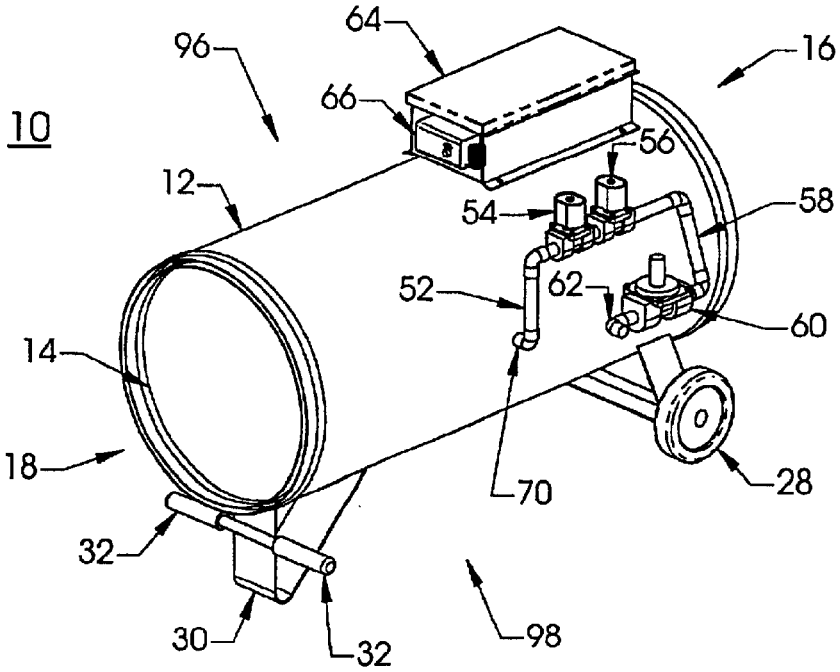
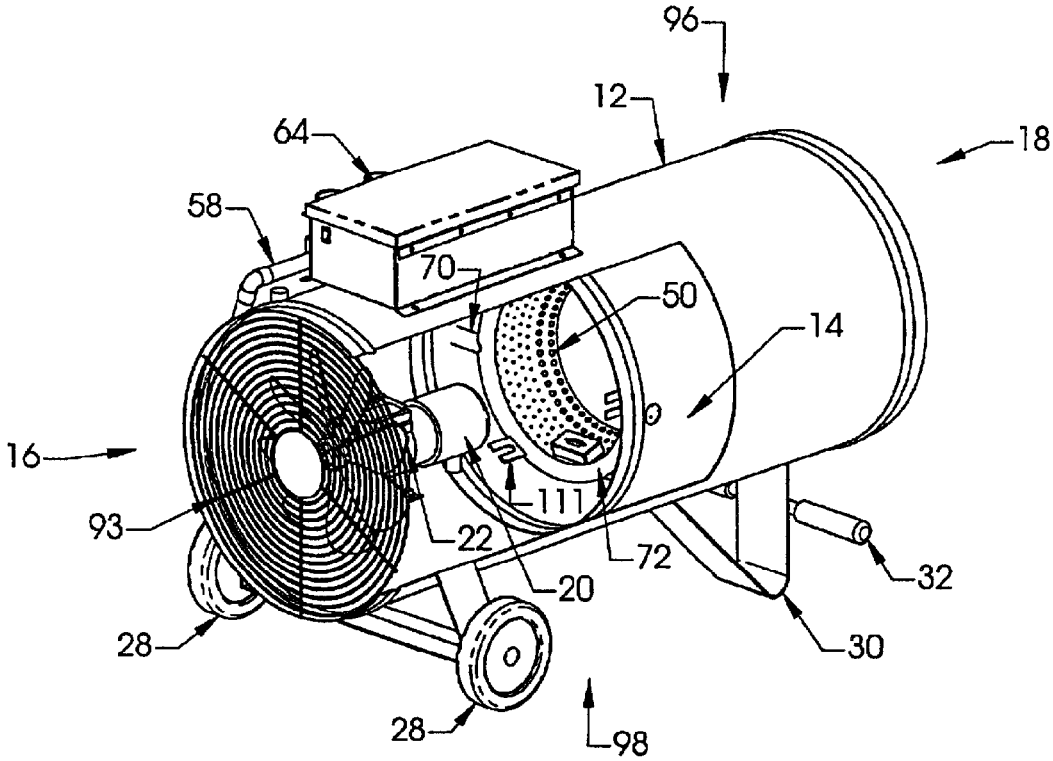
FIG. 4

FIG. 7
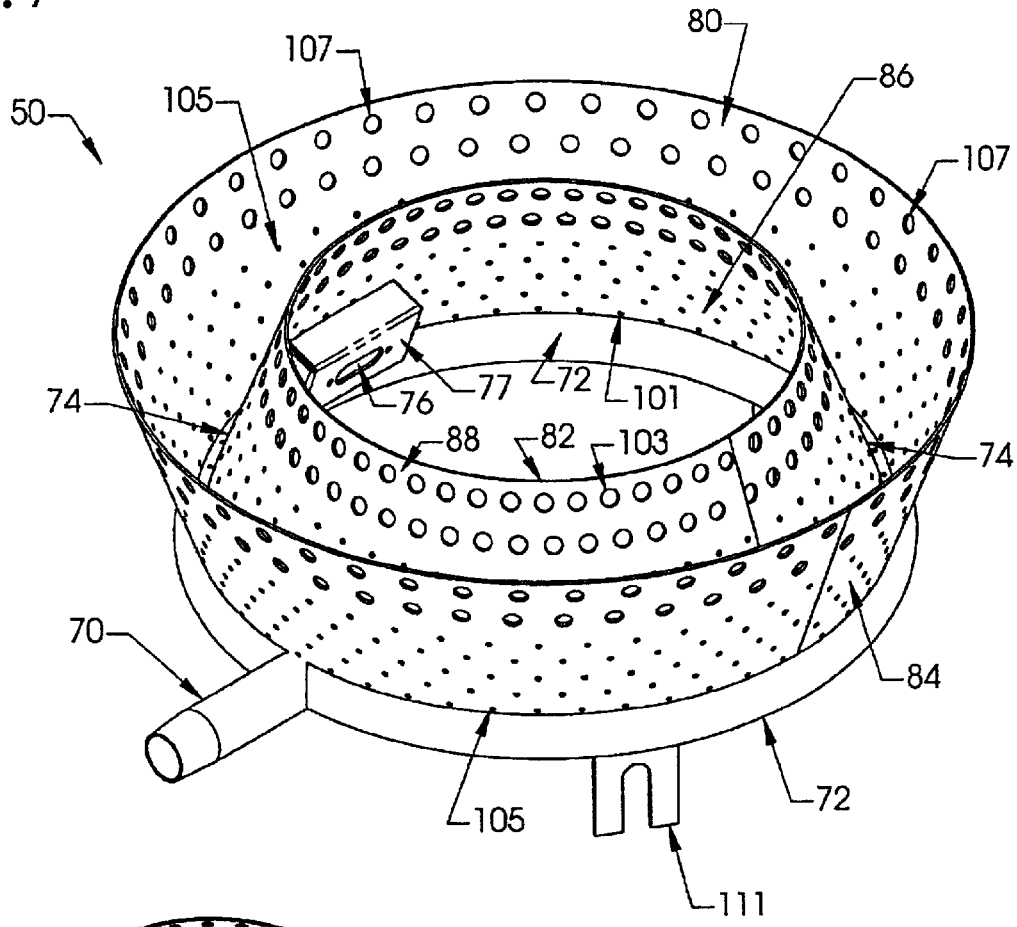
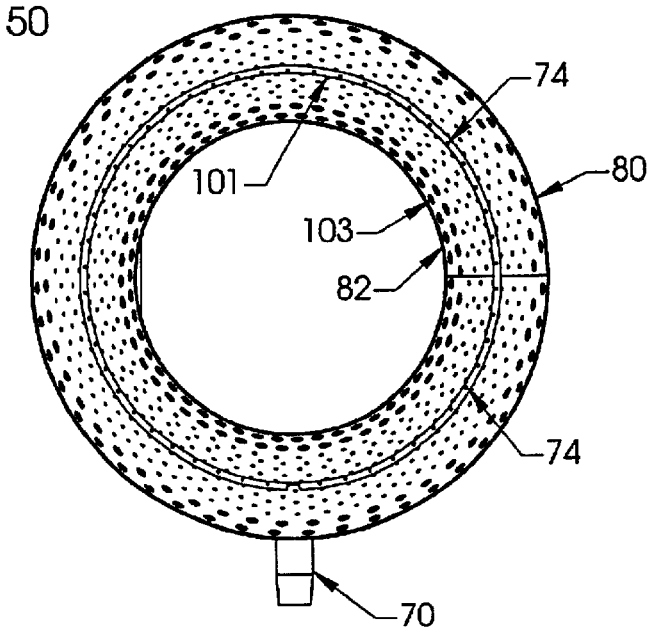
FIG. 8A

COMBUSTION SYSTEM FOR A HEATER

FIELD OF THE INVENTION

The present invention relates generally to heaters and, in particular, a new combustion system for use in a forced-air type heater.

BACKGROUND OF THE INVENTION

Portable heaters are well known. One type of portable heater for commercial use draws air into the heater and forces the air through a flame. As the air passes through the flame, it is heated and output into a room or other structure which is intended to be heated. This type of portable heater is referred to as a forced-air and/or direct-fired heater. In a direct-fired heater, part of the product of the combustion is output into the room or the structure to be heated.

Direct-fired heaters are fairly distinctive in their appearance since they utilize an elongated cylindrical housing. Within the housing is mounted a means for moving the air (usually at a high velocity) and a combustion system.

The means for moving the air consists of a fan (or a propeller) attached to an electric motor. The motor and fan turn at a constant speed and blow air over the combustion system. The combustion system is designed to burn gas (vapor propane or natural gas). A control circuit releases a pre-determined amount of gas and mixes it with air. The air/gas mixture is ignited at the combustion system and, as long as gas is supplied, the fire stays lit.

Mounted on the outside of the housing are valve(s). The valve(s) are connected between an external gas source and the combustion system by tubing. Normally, the valves are completely closed (i.e., "off") or completely open (i.e., "on") and ensure a steady flow of gas to the combustion system. A modulating secondary valve is sometimes utilized.

Air is drawn in by the fan at the inlet or first end of the housing, heated as it passes and mixes with the combustion system and exits through the outlet or second end of the housing.

Although the housing, fan and the electric motor that drives the fan are all fairly typical in such forced-air commercial heaters, the shape and efficiency of the combustion system may be quite different. However, one thing previous burner assemblies in other heaters have in common is that they are not capable of having their input gas flow rate adjusted without affecting safe and efficient combustion. Because of this drawback, most portable direct-fired heaters run at maximum output and are usually designed to produce constant heat while on (e.g., 500,000 British thermal units [Btus] or higher).

SUMMARY OF THE INVENTION

In contrast with prior portable commercial heaters, the present invention is an improved heater having a novel combustion system that burns gas more efficiently—even at reduced gas flow rates. Therefore, the present invention allows the heat output of the heater to be variably controlled. This may be done by replacing the valves with modulating regulators, and connecting the regulators to a new control circuit (e.g., one having a thermostat). Although the present invention is described in connection with a portable heater, it may be utilized by any type of direct-fired heater.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings:

FIG. 3 is an opposite side perspective view of the heater illustrated in FIG. 1;

FIG. 4 is a partial cut-away view of the heater illustrated in FIG. 1 showing the location of the combustion system;

FIG. 7 is a perspective view of the combustion system in accordance with the present invention;

FIG. 8A is a front plan view of the combustion system shown in FIG. 7;

DETAILED DESCRIPTION OF THE PREFERRED EMBODIMENT

Figure 1:
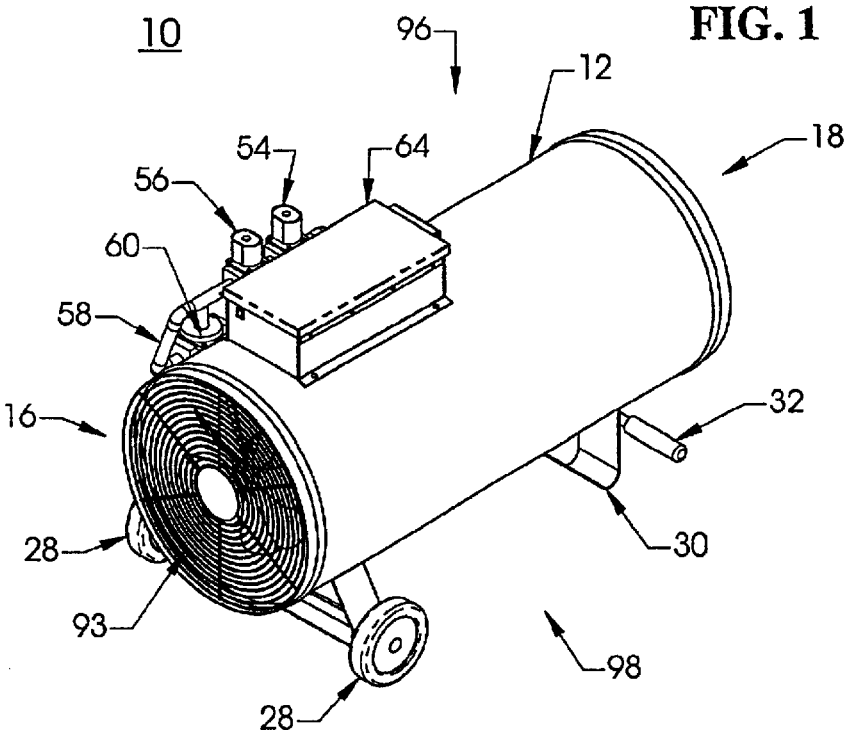
FIG. 1 is a perspective view of a heater utilizing a combustion system in accordance with the present invention.

In describing preferred embodiments of the invention, specific terminology will be selected for the sake of clarity. However, the invention is not intended to be limited to the specific terms so selected, and it is to be understood that each specific term includes all technical equivalents that operate in a similar manner to accomplish a similar purpose.

The terms "right," "left," "top," and "bottom" designate relative directions in the drawings to which reference is made. The terms "inner" and "outer" will be used to refer to a general area inside or outside of the heater.

The preferred embodiments of the present invention will now be described in detail with reference to the accompanying drawings in which a forced-air or direct-fired heater in accordance with the present invention is generally indicated at 10.

Referring to FIG. 1, the forced-air heater 10 includes an elongated, substantially cylindrical housing 12. Although the cylindrical housing 12 may be formed from a plurality of pieces of sheet metal, in the preferred embodiment, one piece of sheet metal is manipulated to form the housing 12. Also, in the preferred embodiment, the housing 12 is made of steel.

Figure 2:
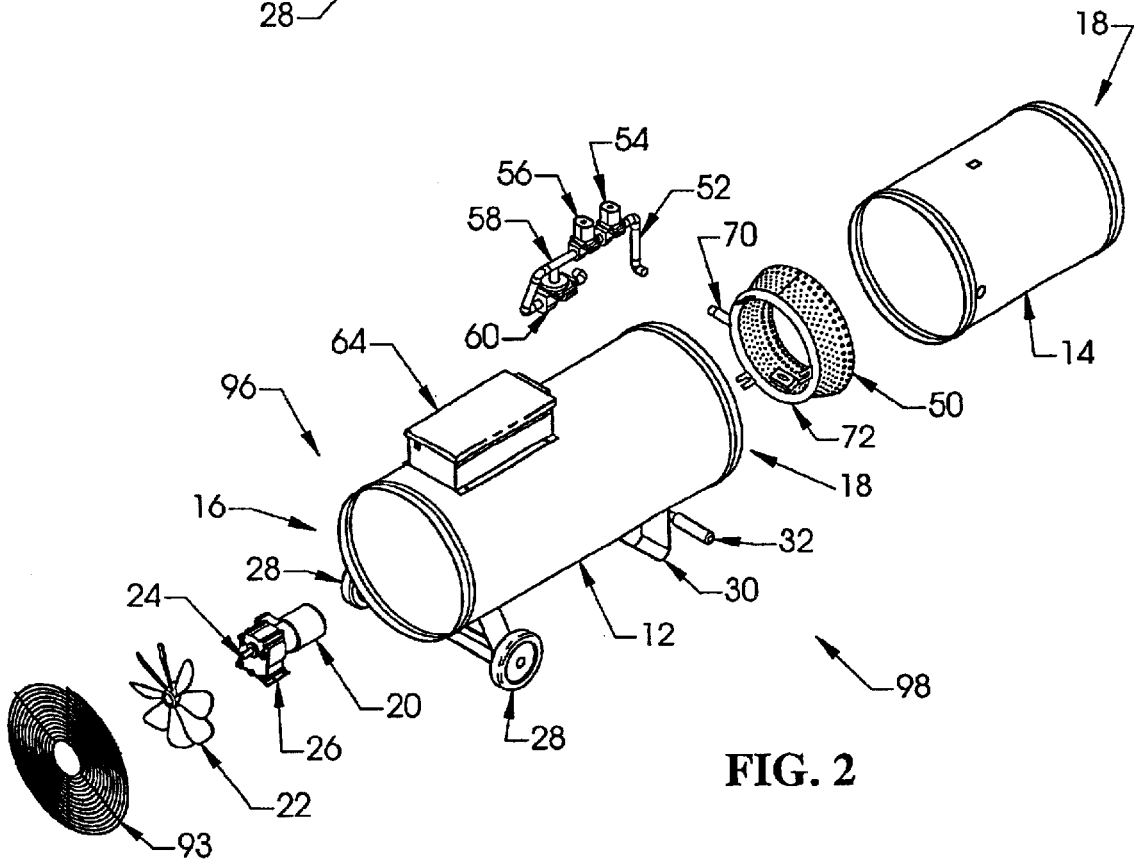
FIG. 2 is an exploded perspective view of the heater illustrated in FIG. 1.
Figure 5:
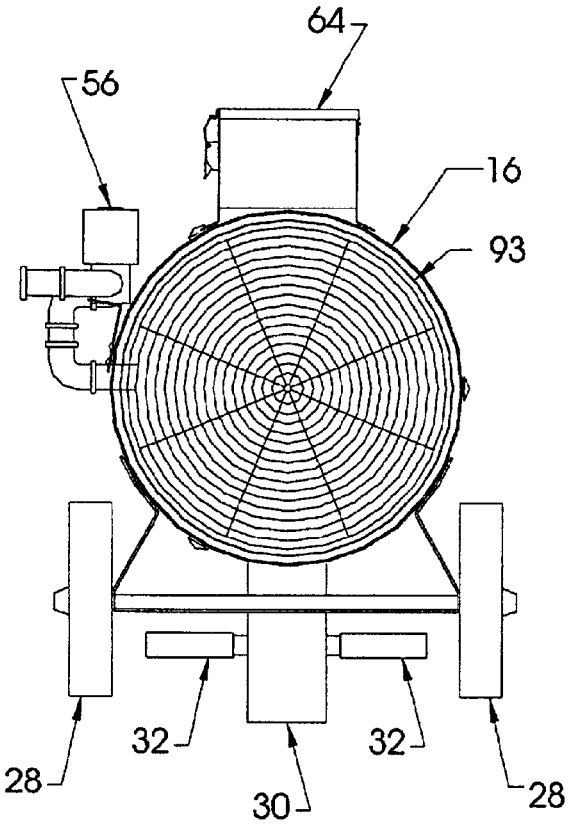
FIG. 5 is a back view of the heater illustrated in FIG. 1 showing the inlet.

Referring now to FIGS. 2, 3 and 4, the housing 12 has an inlet 16, an outlet 18, a top 96 and a bottom 98. A pair of wheels 28 depend from the bottom 98 of the housing 12, and are positioned closer to the inlet 16, to ease moving the heater 10. The wheels 28 are typically made of hard rubber and resist deterioration caused by exposure to the weather or accidental contact with chemicals that may be found at construction sites. A rest 30, mounted on the bottom of the housing 12—at the end opposite to which the wheels 28 are found (i.e., closer to the outlet 18—is used to support the heater 10. A unique handle 32 is mounted to the rest 30 to allow a person to raise the outlet end of the heater and move the heater 10 to a desired position.

The wheels 28, rest 30, and handle 32 are dimensioned and positioned to assist in moving or wheeling the heater 10 from one place to another. Specifically, the wheels 28, rest 30, and handle 32 are designed so that the heater 10 may be pulled or pushed around like a cart.

A liner 14, also substantially cylindrical in shape, may be placed in spaced-apart relation immediately inside of the housing (see FIG. 2). The spaced-apart relationship forms an air gap between the housing 12 and the liner 14 which insulates the housing from the heat-generating and heat-conducting parts of the heater 10. The air gap keeps the housing 12 cool to the touch.

The spaced-apart relation may be achieved by bolting the liner 14 to the inside of the housing 12 and using a plurality of large washers or metallic spacers (not shown) at specific points to maintain the spaced-apart relationship.

The relative position of the liner 14 with respect to the housing 12 is important; if a portion of the liner 14 is too close to the housing 12, a hot spot will appear on the housing 12. Referring now to the partial cutaway view of FIG. 4, in the preferred embodiment, the housing 12 and the liner 14 are substantially concentrically located along their longitudinal axis. However, in order to reduce manufacturing costs, and because it is not necessary to line the entire length of the housing 12, the liner 14 is only slightly longer than one-half the length of the housing 12, when measured from the outlet 18.

Referring again to FIGS. 1 and 2, a grill 93 is fastened to the inlet 16 of the heater 10. The grill 93 prevents large articles from entering and damaging the interior of the heater 10.

A motor 20 is mounted within the housing 12, usually closer to the inlet 16 side of the housing 12. As illustrated in FIGS. 2 and 4, propeller 22 is mounted on the shaft 24 of the motor 20. The shaft of the motor 20 and the propeller 22 are also concentrically located with the axis of the housing 12 and liner 14 as illustrated in FIG. 4.

In the present design, the propeller is positioned closer to the inlet 16 than the motor 20. This design allows for a more efficient flow of air through the housing 12 and liner 14.

In the preferred embodiment, the motor 20 is typically electric and its power is supplied by a wire (not shown) connected to the heater's control circuitry. The control circuitry is located in a control box 64 which is mounted on the outside of the housing 12. As illustrated in FIGS. 1–4, the control box 64 is shown on the top side 96 of the housing 12. The control circuitry will be described more fully hereafter.

Figure 6:
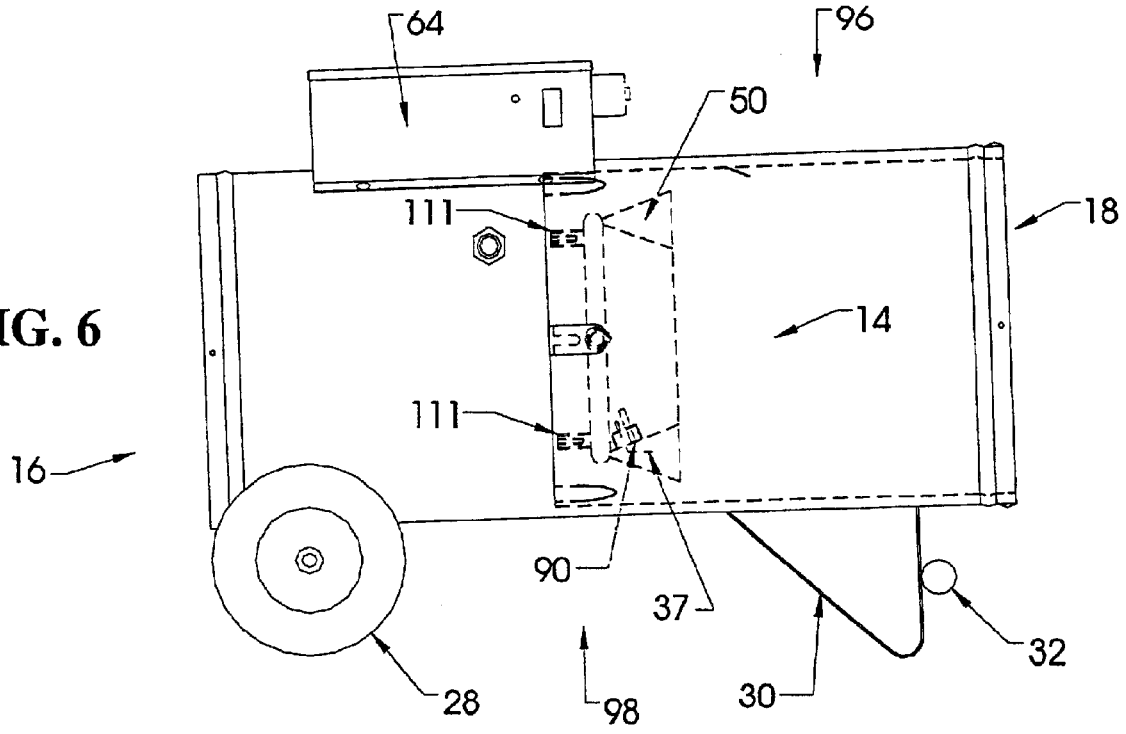
FIG. 6 is a partial cut-away view of the left side of the heater illustrated in FIG. 1.
Figure 8B:
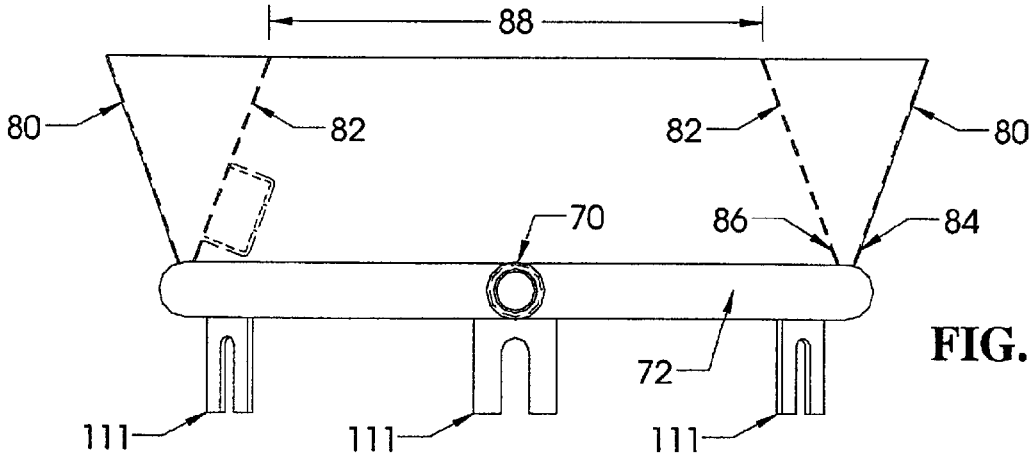
FIG. 8B is a partial cross-sectional side view of the combustion system illustrated in FIG. 8A taken across line 8—8.

Referring now to FIGS. 6 and 7, the combustion system 50 is an important feature of the present invention. A combustion system 50 is mounted within the liner 14. In a preferred embodiment, the combustion system 50 is positioned approximately at the longitudinal midpoint of the housing 12.

The ideal location of the combustion system is calculated based on the maximum output of the heater, the diameter (or volume) of the interior heater body, the air volume moved across the combustion system 50 measured in cubic feet per minute (CFM), and the velocity of the air moved across the combustion system measured in feet per minute (FPM). Generally speaking, the diameter measurement of the combustion system increases in relation to the Btu output of the heater 10.

Referring now to FIGS. 2 and 3, pipe 52 is connected between the combustion system 50 and a pair of solenoid valves 54, 56 in the pipe-train assembly that controls the pre-regulated gas to the combustion system 50. The first solenoid valve 54 controls the flow of gas to the combustion system 50. The second solenoid valve 56 is a redundant system used to meet certification requirements for safety if the first solenoid valve 54 were to fail.

Pipe 58 connects the solenoid valves 54, 56, to a regulator 60 which in turn is connected to an external gas source via pipe 62.

Referring now to FIG. 7, the combustion system 50 is mounted within the liner 14 via a plurality of ears 111 (in a preferred embodiment three equally-spaced ears are used). The combustion system 50 has a gas inlet tube 70 that connects to pipe 52.

The combustion system 50 comprises a circularly-shaped burner tube 72 having a plurality of gas exit holes 74 on one side (i.e., the side facing the outlet of the housing 18). The burner tube 72 has a pre-determined diameter that depends on the Btu output of the heater 10 and the volume of air forced over the combustion system 50.

Gas enters the combustion system 50 through tube 70 and eventually is relatively evenly distributed throughout ring-shaped burner tube 72. As gas leaves via gas exit holes 74 it is ignited by ignitor 90. After the gas is ignited, the control circuit ensures that a stream of gas exits gas holes 74, thereby ensuring that a flame is continuously lit at the combustion system 50.

A flame sensor 37 can have dual functions, initially it can act as the ignition source and light or ignite the air/gas mixture to initiate proper combustion, and secondly it provides flame rectification thus signaling to the control circuit that there is proper combustion to the control circuit to maintain the gas valves open 54, 56 and discontinue the ignition source.

Referring now to FIGS. 8A, 8B, 9A and 9B, the combustion system 50 has a first frusta conical section 82 (sometimes referred to as the first flange) having a pre-determined first pattern of orifice ports 101, 103. The first frusta conical section 82 has a basal end 86 having a diameter proximate the diameter of the burner tube 72 and a smaller diameter secondary end 88. The basal end 86 being attached to the burner tube at a position radially inward from said gas exit holes 74.

The combustion system 50 also has a second frusta conical section 80 (sometimes referred to as the second flange) having a pre-determined second pattern of vent holes 105, 107. The second frusta conical section 80 has a basal end 84; the basal end 84 of the second frusta conica having a diameter proximate the diameter of the burner tube 72. The basal end 84 is attached to the burner tube at a position radially outward from said gas exit holes 74.

The lengths of the air/gas mixing frusta conical sections or flanges are determined by the desired heat output of the combustion system.

The dimension of this assembly is a relative to the following:

The diameter or area of the interior heater body.

the air volume moved across the combustion system measured in cubic feet per minute (CFM)

The velocity of the air moved across the combustion system measured in feet per minute (FMP).

Generally speaking, the length of this conical frusta system or flange increases proportionately in relation to the Btu output of the heater.

The size and the placement of the orifice ports 101 and 105 closest to the basal ends of the flanges are smaller in diameter than the orifice ports 103, 107 on the perimeter. In the preferred embodiment, there are five rows of smaller diameter orifice ports 101, 105 in each flange and two rows of large diameter orifice ports 103, 107. However, there may be more or less smaller diameter and/or large diameter orifices depending on the Btu output of the heater.

Figure 9A:
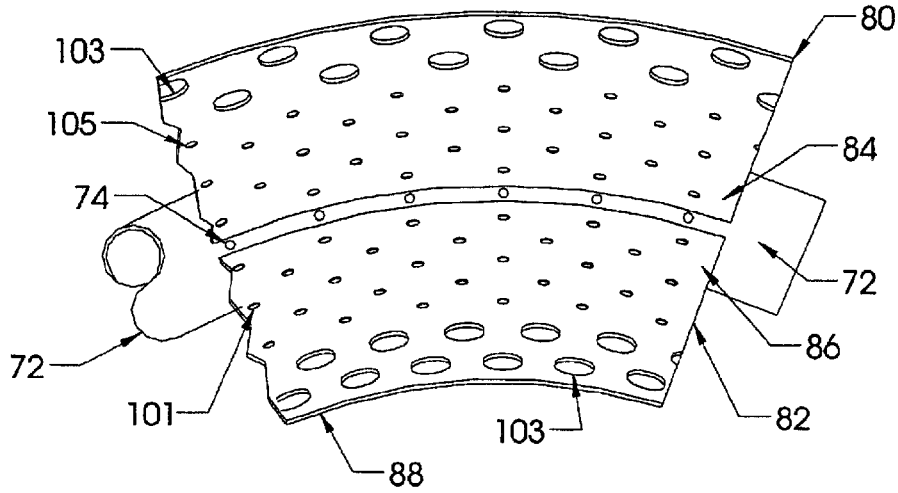
FIG. 9A is an enlarged front plan view of a section of the combustion system illustrated in FIG. 8A showing the details of the flanges.
Figure 9B:
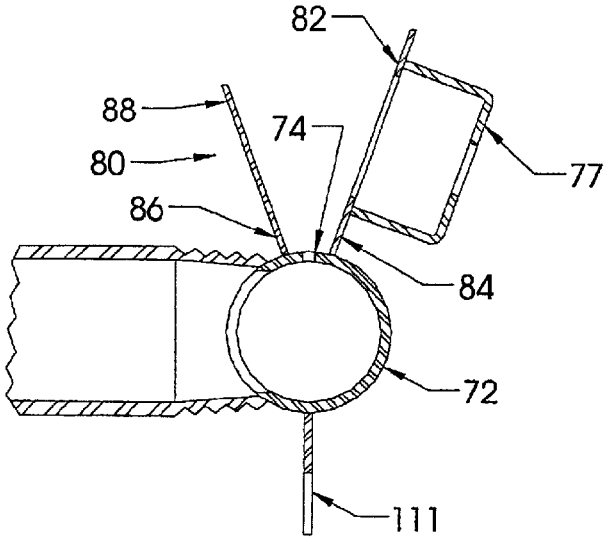
FIG. 9B is a cross-sectional view of the combustion system section illustrated in FIG. 9A taken across line 9—9.

Each row of orifice ports is staggered from the adjacent rows. As illustrated in FIGS. 7 and 9A, the ports are positioned such that a diagonal line may be drawn through a set of seven orifice ports (five smaller diameter and two larger diameter ports). This actually gives the ports a spiral-like appearance. Moreover, the first row of ports 101, 105 of each flange 82, 80 are aligned with the gas exit holes 74 of the burner tube 72. The pattern of the ports 101, 103, 105, and 107 with respect to the gas exit holes 74 allow the heater 10 to be variably controlled. That is, to the combustion system 50 uniquely mixes the air with the gas so that the air/gas mixture is efficiently burned so that the heat output of the heater may be adjusted from about 20% to 100% of the rated output and the heater does not have to be continuously operated at its maximum output.

Referring now to FIGS. 4 and 7, a mounting box 77 is secured to the first frusta conical member. The ignitor 90 is positioned inside the mounting box 77. The mounting box 77 provides a pocket for gas to accumulate upon initial ignition or start-up. This pocket of gas surrounds the ignitor ensuring that the gas comes in direct contact with the igniter and promoting a quick and complete ignition.

An electronic control circuitry is preferably protected within control box 64. The control box 64 is mounted on the top of housing 12. The electronic control circuitry includes an ignitor circuit; switches/relays (for controlling the operation of the motor 20, the operation of the regulator 60 and the opening and closing of solenoid valves 54, 56), a thermostat 66 and an on/off switch 67. An AC power cord (not shown) provides electrical power to the control circuitry.

The control circuitry is similar to the control circuitry in other direct-fired heaters and is a key element in the safe operation of the combustion system. An important difference, though, is that the subject control circuitry includes circuits to allow the variable or gradual adjustment of the heater's output. The control circuit, when signaled by the operator to start the combustion process, activates the ignition circuit. The ignition circuit and the solenoid valves 54, 56 are activated beginning the flow of gas into the combustion system 50 and over the ignition source.

A flame sensor 37, positioned proximate to the mounting box 77, extends beyond the physical dimensions of the mounting box and into the path of the flame after combustion has been established. The sensor 37 is connected to the control circuitry and provides feedback as to the amount of heat, quality of combustion and/or type of flame at the frusta conical members. The flame sensor 37, in combination with the mounting box 77, allows the control circuitry to accurately detect the flame, thereby allowing a wide range of turn down (i.e., adjustability) in the volume of incoming gas. In this manner, the heater 10 can vary its output over a relatively wide range, for example from 100% to about 20% of capacity, while maintaining clean combustion and to make flame rectification as needed.

Figure 10A:
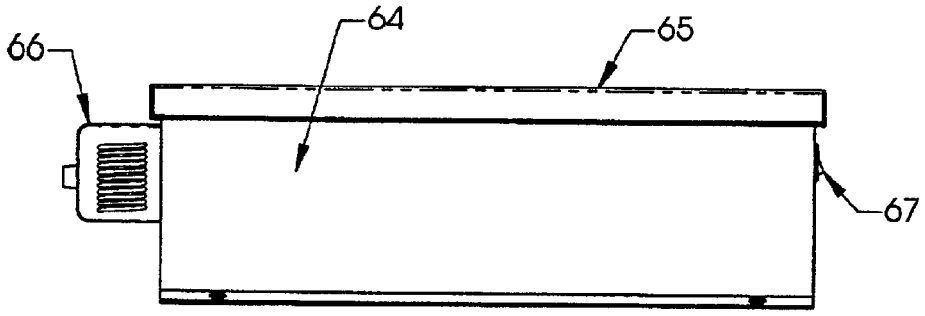
FIG. 10A is an enlarged right side plan view of the control box in accordance with the present invention.
Figure 10B:
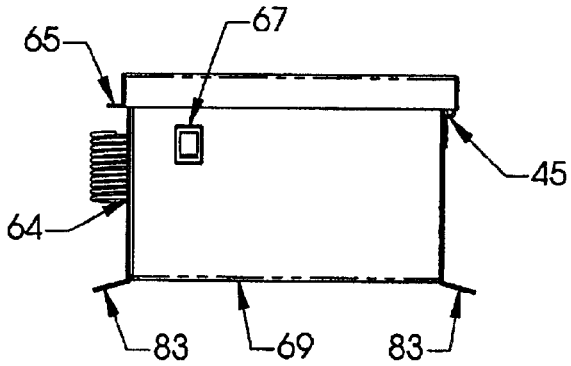
FIG. 10B is an enlarged front plan view of the control box illustrated in FIG. 10A illustrating the switch cut-out.

Referring now to FIGS. 10A and 10B, the control box 64 has a lid 65, a base 69, and a mounting bracket 83. The control box 64 is preferably constructed of stainless steel to prevent corrosion and to extend the life of the control circuitry secured inside. As shown in FIGS. 10A and 10B, the control box has an integrated piano hinge 45 which allows easy access for maintenance. A tool-less latch (not shown) keeps the lid securely closed and an integrated gasket resists the entry of water and moisture, thereby reducing the possibility that the control circuitry will corrode.

Figure 10C:
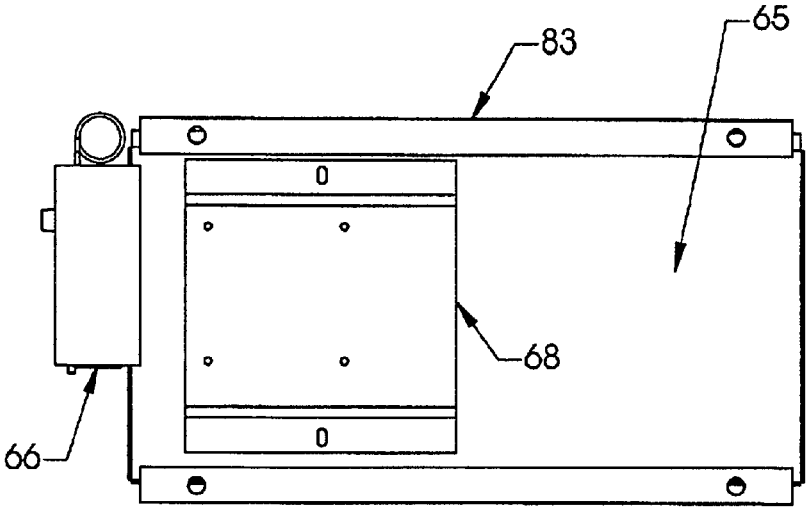
FIG. 10C is an enlarged top plan view of the internal mounting plate used to secure at least part of the control circuitry within the control box.

The control box 64 is mounted on the housing 12 with the bracket 68. Referring now to FIG. 10C, bracket 83 fits inside of control box 64 and the control circuit is mounted to it. The bracket improves production flow, hides all attachment bolts, and creates an integrated or streamlined look to the heater 10.

If the combustion system 50 is positioned approximately midway along the axial length of the housing 12, then the liner 14 extends from the outlet 18 to a point slightly past the axial midpoint. Since the air is heated as it passes the flame at the combustion system 50, the liner 14 does not have to extend all the way from the outlet 18 to the inlet 16.

The interior portion of the liner 14 from the combustion system 50 to the outlet 18 serves as a combustion chamber. An ignitor 90 is mounted on the interior of inner flange 82. The ignitor 90 produces a spark to light the gas exiting the combustion system 50. The ignitor 90 is connected to the electronic control circuit.

Upon initial start-up, the on/off switch 67 sends line voltage to the fan motor 20. When the motor turns, propeller (fan) 22 begins to spin. Air is drawn into inlet 16. As the propeler (fan) 22 picks up rotational speed, air is forced through the combustion system 50 and around the flanges 80, 82. Substantially contemporaneously, the control circuitry sends a signal to the solenoids 54, 56 and the regulator to open, thereby allowing gas to flow from external gas source to the combustion system 50. Simultaneously, the control circuitry also sends a signal to the ignitor 90 which produces a controlled spark thereby igniting the gas exiting from gas holes 74. A flame appears between the flanges 82, 80. As air passes over and around the flanges 81, 80, it is heated and eventually exits from outlet 18. This heated air then raises the temperature of the ambient air in the room or structure to be heated.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

I claim:

1. A combustion system for use in a gas burning heater, the combustion system comprising:

a circularly-shaped burner tube having a plurality of gas exit holes on one side and a means for feeding a controlled amount of gas thereto, said burner tube having a set diameter;

a first conical frustum section having a pre-determined first pattern of orifice ports, the first conical frustum section having a basal end and a smaller diameter distal end, the basal end of the first conical frustum section being concentrically attached to the burner tube adjacent to said plurality of gas exit holes at a position radially inward from said gas exit holes, said distal end of the first conical frustum section extending generally in the direction in which the gas would exit said gas exit holes; and a second conical frustum section having a pre-determined second pattern of orifice ports, said second conical frustum section having a basal end and a larger diameter distal end, said basal end of the second conical frustum section concentrically attached to the burner tube adjacent to said plurality of gas exit holes at a position radially outward from said gas exit holes, said distal end of the second conical frustum reaction extending generally in the direction in which the gas would exit said gas exit holes.

2. The combustion system of claim 1 wherein said gas exit holes are equally-spaced around said burner tube.

3. The combustion system of claim 2 wherein said gas exit holes are of a predetermined diameter.

4. The combustion system of claim 3 wherein said gas exit holes are orthogonally positioned to a plane defined by the circularly-shaped burner tube.

5. The combustion system of claim 1 wherein said pre-determined first pattern of orifice ports are arranged in a spiral-shaped pattern.

6. The combustion system of claim 5 wherein said pre-determined second pattern of orifice ports are arranged in a spiral-shaped pattern.

7. The combustion system of claim 6 wherein said pre-determined second pattern of orifice ports includes seven rows of orifice ports.

8. The combustion system of claim 7 wherein the last two rows of the predetermined second pattern of orifice ports proximate the distal end are larger in diameter than the first five rows closest to the basal end.

9. The combustion system of claim 8 wherein said pre-determined first pattern of orifice ports includes seven rows of orifice ports.

10. The combustion system of claim 9 wherein the last two rows of the predetermined second pattern of orifice ports proximate the distal end are larger in diameter than the diameter of the orifice ports positioned in the first five rows closest to the basal end.

11. The combustion system of claim 10 wherein the first row of orifice ports closest to the basal end on said first and second frusta conical sections are equal in number to and aligned with said plurality of gas exit holes.

12. The combustion system of claim 1 wherein said means for feeding a controlled amount of gas to said gas exit holes is variable thereby allowing for the adjustment of the heat output of the combustion system.

13. The combustion system of claim 1 wherein said predetermined first pattern of orifice ports include ports of more than one diameter and said pre-determined second pattern of orifice ports includes ports of more than one size.

14. A combustion system for use in a gas burning heater, the combustion system defining a combustion chamber within the gas burning heater, the combustion system comprising:

a circularly-shaped burner tube having a plurality of gas exit holes on one side, said burner tube having a diameter determined by the desired output of the gas burning heater;

a means for delivering gas to said burner tube;

a first conical frustum section having a pre-determined first pattern of orifice ports, the first conical frustum section having a basal end having a diameter about equal to the diameter of the burner tube, the basal end of the first conical frustum section being concentrically attached to the burner tube adjacent to said plurality of gas exit holes at a position radially inward from said gas exit holes, the first conical frustum section having a converging profile as the axial distance away from the burner tube increases in the general direction in which the gas would exit said gas exit holes; and a second conical frustum section having a pre-determined second pattern of orifice ports, said second conical frustum section having a basal end having a diameter about equal to the diameter of the burner tube, said basal end of the second conical frustum section being concentrically attached to the burner tube adjacent to said plurality of gas exit holes at a position radially outward from said gas exit holes, the second conical frustum section having a diverging profile as the axial distance away from the burner tube increases in the general direction in which the gas would exit said gas exit hole;

said first and second conical frusta sections communicating with the burner tube for mixing the appropriate amount of air to the volume of gas exiting said gas exit holes for defining a combustion chamber within the gas heater when burning said gas.

15. The combustion system of claim 14 wherein said pre-determined first pattern of orifice ports on said first conical frustum section includes a plurality of evenly-spaced rows of orifice ports.

16. The combustion system of claim 15 wherein at least the last row of the plurality of evenly-spaced rows of orifice ports proximate the distal end are larger in diameter than the first row closest to the basal end.

17. The combustion system of claim 16 wherein said pre-determined second pattern of orifice ports on said second conical frustum section includes a plurality of evenly-spaced rows of orifice ports.

18. The combustion system of claim 17 wherein at least the last row of the pre-determined second pattern of evenly-spaced rows of orifice ports proximate the distal end are larger in diameter than the first row closest to the basal end.

19. The combustion system of claim 14 wherein said means for feeding a controlled amount of gas to said burner tube may be variably controlled.

20. The combustion system of claim 19 further comprising a flame sensor that communicates with the exiting gas and provides flame rectification of the burning gas and works in combination with the means for feeding gas to improve combustion.

21. The combustion system of claim 14 wherein said predetermined first pattern of orifice ports include ports of more than one diameter and said pre-determined second pattern of orifice ports includes ports of more than one diameter.

* * * * *